US010699851B2

(12) United States Patent
Ganguli et al.

(10) Patent No.: US 10,699,851 B2
(45) Date of Patent: Jun. 30, 2020

(54) SINTERED ELECTRICAL CONTACT MATERIALS

(71) Applicant: Teledyne Scientific & Imaging, LLC, Thousand Oaks, CA (US)

(72) Inventors: Rahul Ganguli, Oak Park, CA (US); Payam Minoofar, Ventura, CA (US); Michael Calabrese, Newbury Park, CA (US)

(73) Assignee: TELEDYNE SCIENTIFIC & IMAGING, LLC, Thousand Oaks, CA (US)

( * ) Notice: Subject to any disclaimer, the term of this patent is extended or adjusted under 35 U.S.C. 154(b) by 893 days.

(21) Appl. No.: 15/189,870

(22) Filed: Jun. 22, 2016

(65) Prior Publication Data

US 2017/0372850 A1 Dec. 28, 2017

(51) Int. Cl.

| | |
|---|---|
| ***C22C 5/06*** | (2006.01) |
| ***H01H 1/023*** | (2006.01) |
| ***H01H 11/04*** | (2006.01) |
| ***C22C 32/00*** | (2006.01) |
| ***B22F 1/00*** | (2006.01) |
| ***B22F 3/16*** | (2006.01) |
| ***B22F 3/24*** | (2006.01) |

(Continued)

(52) U.S. Cl.

CPC ..... *H01H 1/023* (2013.01); *B22F 1/007* (2013.01); *B22F 3/16* (2013.01); *B22F 3/24* (2013.01); *B22F 5/12* (2013.01); *B22F 9/04* (2013.01); *C22C 5/06* (2013.01); *C22C 32/0089* (2013.01); *H01H 11/048* (2013.01); *B22F 2009/045* (2013.01); *B22F 2301/255* (2013.01); *B22F 2302/45* (2013.01); *B22F 2998/10* (2013.01)

(58) Field of Classification Search

CPC ..... H01H 1/023; H01H 11/048; B22F 5/12; B22F 9/04; B22F 3/24; B22F 3/16; B22F 1/007; B22F 2301/255; B22F 2998/10; B22F 2302/45; B22F 2009/045; C22C 32/0089; C22C 5/06

USPC ..... 420/501

See application file for complete search history.

(56) References Cited

U.S. PATENT DOCUMENTS 3,322,512 A * 5/1967 Jones ..... C22C 25/00 75/250
4,312,772 A * 1/1982 Mori ..... C10M 7/00 428/545

(Continued)

FOREIGN PATENT DOCUMENTS

CN 1049998 C 3/2000
CN 101613593 A 12/2009

OTHER PUBLICATIONS

Extended European Search Report for European Patent Application No. 17176557.1 dated Oct. 27, 2017.

(Continued)

*Primary Examiner* — Haytham Soliman
(74) *Attorney, Agent, or Firm* — K&L Gates LLP

(57) ABSTRACT

The sintered electrical contact material described in this specification includes at least one salt dispersed within a silver matrix, and no more than 100 ppm of cadmium and cadmium compounds. The sintered electrical contact material exhibit contact resistances much lower than commercially available silver composites. The salts dispersed within the silver matrix represent a new class of additives for silver composites for high and low current applications.

11 Claims, 5 Drawing Sheets

(51) Int. Cl.
*B22F 5/12* (2006.01)
*B22F 9/04* (2006.01)

(56) References Cited

U.S. PATENT DOCUMENTS 5,990,440 A * 11/1999 Yamaguchi ..... H01H 9/302
218/158
2002/0189720 A1* 12/2002 Sakaguchi ..... C22C 1/0466
148/431

OTHER PUBLICATIONS

Kenisarin, M., "High-temperature phase change materials for thermal energy storage", Renewable and Sustainable Energy Reviews, 2010, vol. 14, pp. 955-970.
Allen et al., "The Effect of Microstructure on the Electrical Performance of Ag—WC—C Contact Materials", 1998, Proceedings of the Forty-fourth IEEE Holm Conference on Electrical Contacts, pp. 276-285.
"Silver Based Materials, Electrical Contacts", http://www.electrical-contacts-wiki.com/index.php/Silver_Based_Materials, Sep. 24, 2014, 35 pages.
Talijan, N., "Electrical contact materials based on silver", 2011,broj 3, Zaštita Materijala, vol. 52, pp. 173-180.

* cited by examiner

SINTERED ELECTRICAL CONTACT MATERIALS

BACKGROUND OF THE TECHNOLOGY

Field of Technology

The present disclosure relates to sintered electrical contact materials. In particular, certain non-limiting aspects of the present disclosure relate to electrical contact materials including a silver matrix, up to 15% (wt/wt) of at least one salt dispersed within the silver matrix, and no more than a limited concentration of cadmium and cadmium compounds. The present disclosure is also directed to methods of producing the materials of the present disclosure.

Description of the Background of the Technology

The information described in this background section is not admitted to be prior art.

Silver-cadmium oxide (Ag—CdO) composite materials are currently conventionally used for electrical contactors in switches, relays, and other electrical equipment. In operation, voltage-carrying electrical contact materials are advanced toward and away from each other, resulting in electrical arcing. The temperature of arc plasmas can range from, for example, 5700° C. to 9700° C. During a normal service lifetime, an electrical contact material may be subjected to thousands of arc cycles, e.g., 4,000-5,000 arc cycles.

Because of cadmium's toxicity, investigations have been directed toward replacing CdO with non-toxic oxides in the silver matrix of the electrical contact material. Such investigations have focused on using other metal oxides, such as tin oxide ($SnO_2$), bismuth oxide ($Bi_2O_3$ or bismite), and copper oxide (CuO). Of these materials, Ag—$SnO_2$ is the leading Ag—CdO substitute. However, Ag—$SnO_2$ is substantially inferior to Ag—CdO because Ag—$SnO_2$ has a higher initial contact resistance than Ag—CdO. Further, the contact resistance of Ag—$SnO_2$ increases more rapidly compared to Ag—CdO over the lifetime of the contactor due to metal oxide slag formation. Additional components have been utilized to alleviate the slag formation in Ag—$SnO_2$, but no approach has successfully provided a contact resistance comparable to Ag—CdO. Thus, there has developed a need for improved electrical contact materials that overcome limitations of conventional Ag—CdO electrical contact materials which are toxic, and the limitations of Ag—CdO replacements which fail to provide comparable contact resistance.

SUMMARY

The present disclosure, in part, is directed to electrical contact materials and methods that address certain of the limitations of conventional electrical contact materials and replacement materials for CdO in silver composite electrical contact materials. Certain embodiments herein address limitations of proposed replacement materials for CdO in silver composite electrical contact materials regarding contact resistance and heat dissipation.

In one non-limiting example according to the present disclosure, a sintered electrical contact material comprises: a silver matrix; up to 15% (wt/wt) of at least one salt dispersed within the silver matrix; and no more than 100 parts per million ("ppm") of cadmium and cadmium compounds. In certain non-limiting embodiments of the electrical contact material, the salt dispersed within the silver matrix has a melting temperature below 960° C.

In another non-limiting example according to the present disclosure, a method of producing a sintered electrical contact material comprises: homogenizing a mixture comprising a silver powder and up to 15% (wt/wt) of particles of at least one salt; compacting at least a portion of the homogenized mixture to provide a compact; and sintering the compact. In certain non-limiting embodiments of the method, the at least one salt has a melting temperature below 960° C.

It is understood that the invention described in this specification is not necessarily limited to the examples summarized in this Summary.

BRIEF DESCRIPTION OF THE DRAWINGS

Features and advantages of the materials and methods described herein may be better understood by reference to the accompanying drawings in which.

Figure 1:
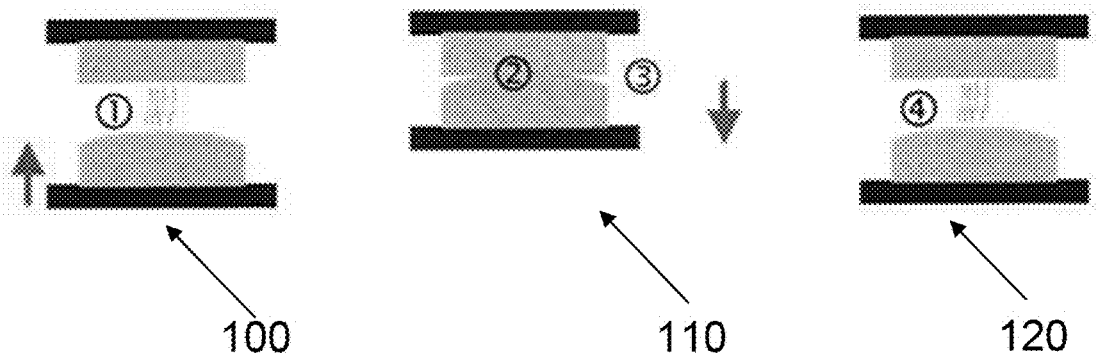
FIG. 1 is a schematic illustrating certain features a non-limiting embodiment of a method of using sintered electrical contact materials according to the present disclosure.

It should be understood that the invention is not limited in its application to the arrangements illustrated in the above-described drawings. The reader will appreciate the foregoing details, as well as others, upon considering the following detailed description of certain non-limiting embodiments of electrical contact materials and methods according to the present disclosure. The reader also may comprehend certain of such additional details upon using the electrical contact materials and/or practicing the methods described herein.

DETAILED DESCRIPTION OF CERTAIN NON-LIMITING EMBODIMENTS

In the present description of non-limiting embodiments and in the claims, other than in the operating examples or where otherwise indicated, all numbers expressing quantities or characteristics of ingredients and products, processing conditions, and the like are to be understood as being modified in all instances by the term "about." Accordingly, unless indicated to the contrary, any numerical parameters set forth in the following description and the attached claims are approximations that may vary depending upon the desired properties one seeks to obtain in the electrical contact materials and methods according to the present disclosure. At the very least, and not as an attempt to limit the application of the doctrine of equivalents to the scope of the claims, each numerical parameter should at least be construed in light of the number of reported significant digits and by applying ordinary rounding techniques.

The present disclosure, in part, is directed to electrical contact materials and methods that address certain of the limitations of conventional electrical contact materials and replacement materials for CdO in silver composites. According to certain non-limiting embodiments, a sintered electrical contact material includes a silver matrix and at least one salt dispersed within the silver matrix. Silver may provide for a cost effective matrix material for the electrical contactor. In certain non-limiting embodiments, the matrix of the electrical contactor may include other suitably noble inert metals. Certain non-limiting embodiments of the material according to the present disclosure are used for electrical contactors requiring repeated arcing at high temperatures, as further explained below. Through repeated use of the electrical contactors, such arcing may potentially cause oxidation. Depending on the usage requirements or preferences for the particular electrical contactor, other metals such as copper may not provide the requisite oxidation resistance for the electrical contactor.

In certain non-limiting embodiments, the salt may be present in an amount of up to 15%, by weight based on the total weight of the sintered electrical contact material. In certain non-limiting embodiments of the electrical contact materials and methods, the salt dispersed within the silver matrix has a crystalline structure and further has a melting temperature below 960° C., the melting temperature of silver. According to certain other non-limiting embodiments, the salt may be present in an amount ranging from 0.5 to 10%, by weight based on the total weight of the sintered electrical contact material. According to certain other non-limiting embodiments, the salt may be present in an amount ranging from 2 to 5%, by weight based on the total weight of the sintered electrical contact material.

In certain non-limiting embodiments of the electrical contact materials and methods, the salt dispersed within the silver matrix undergoes a reversible, endothermic (heat-absorbing) phase change or transformation, e.g., changes from solid to liquid. These salts may be chosen for their ability to store and release heat reversibly as they are exposed to temperature ranges. In this regard, cadmium and cadmium oxide cannot be considered as the salt dispersed within the silver matrix, because cadmium evaporation and cadmium oxide decomposition are both irreversible processes. The salts according to the present disclosure can include compositions based on fluorides, chlorides, hydroxides, nitrates, and carbonates, so long as the salts undergo a reversible, endothermic phase change or transformation and otherwise are suitable for use in electrical contactors.

According to certain non-limiting embodiments of the present disclosure, the salt dispersed within the silver matrix may undergo at least one reversible, endothermic phase change between ambient temperature (about 20° C.) and the melting temperature of silver (about 961.8° C.). According to certain non-limiting embodiments, the salt dispersed within the silver matrix undergoes multiple reversible, endothermic phase changes above ambient temperature and below 960° C. According to other non-limiting embodiments, the salt dispersed within the silver matrix undergoes at least one reversible, endothermic phase change above ambient temperature and below 800° C.

According to certain non-limiting embodiments, the salt included in the sintered electrical contact material according to the present disclosure is selected from lithium fluoride, zinc nitride, sodium sulfate, and magnesium carbonate. Depending on the use requirement or preferences for the particular electrical contact material, the salts dispersed within the silver matrix do not agglomerate and may inhibit slag formation during use of the electrical contact material. Ionic salt additives such as lithium fluoride (LiF), sodium sulfate ($Na_2SO_4$), and magnesium carbonate ($MgCO_3$) can exhibit a relatively high heat of fusion (e.g., greater than 24 kJ/mol) and melt below 800° C. According to other non-limiting embodiments, a ceramic covalent phase change material can be used in place of the salt. Zinc nitride ($Zn_3N_2$) undergoes a reversible, endothermic morphology change at approximately 600° C.-700° C., and is one example of the ceramic covalent phase change material. The one or more reversible, endothermic transformations of the salts and/or ceramic covalent phase change material of the present disclosure can reduce silver loss resulting from the heating effect of electrical arcing.

According to certain non-limiting embodiments, a sintered electrical contact material according to the present disclosure includes no more than 100 ppm (wt/wt) of cadmium and cadmium compounds. According to other non-limiting embodiments, a sintered electrical contact material according to the present disclosure includes no more than an incidental concentration of cadmium and cadmium compounds. According to other non-limiting embodiments, a sintered electrical contact material according to the present disclosure is free or is substantially free of cadmium and cadmium compounds.

Depending on the use requirement or preferences for the particular electrical contact material, alternative oxide materials may not match certain performance characteristics of cadmium oxide in conventional silver composite contact materials. For example, metal oxides differing from cadmium oxide may not retard contactor erosion due to arcing. Slag formation due to the use of alternative metal oxides may lead to increased contact resistance. Contacts including alternative metal oxides may be prone to arc welding, which shortens the lifespan of the contacts.

According to certain non-limiting embodiments, the salt dispersed in the silver matrix of the electrical contact material according to the present disclosure may have a particle size ranging from 0.5 microns to 10 microns, or ranging from 1 micron to 10 microns. In certain non-limiting embodiments, the material dispersed in the silver matrix may have a particle size ranging from 0.5 microns to 10 microns, or ranging from 1 micron to 10 microns. In certain non-limiting embodiments, the particle size is an average with the particle distribution size centered about the stated particle size. In certain non-limiting embodiments, if the particle size is between 0.5 microns to 10 microns, at least 90% of the particles are sized between 0.5 microns to 10 microns.

Referring to FIG. 1, a non-limiting embodiment of a method of using sintered electrical contact materials according to the present disclosure is illustrated. The method includes bringing together contactors that include at least one salt dispersed therein (100). As the contactors are brought together, electrical arcing occurs. The contactors are forced together (110) and are heated as high current passes through the contactors. As the contactors are separated (120), electrical arcing occurs again.

Figure 2A:
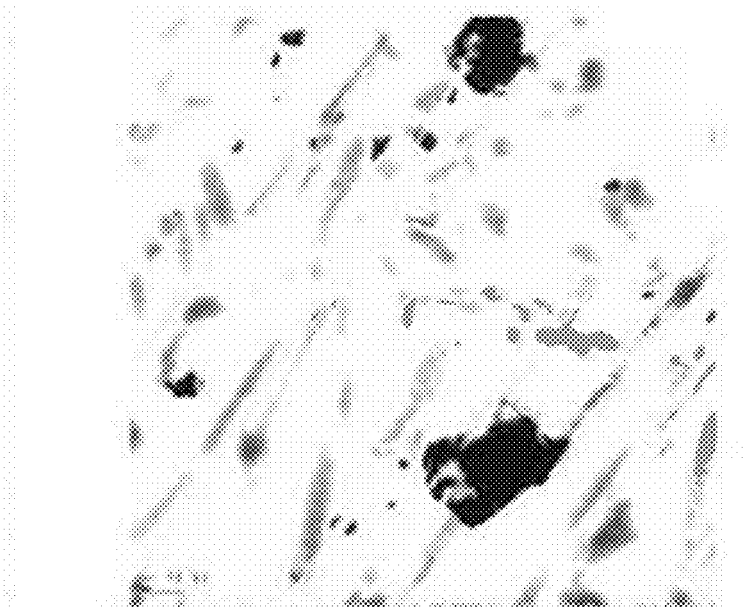
FIGS. 2A and 2B are micrographs of a non-limiting embodiment of a sintered electrical contact material according to the present disclosure before arcing (FIG. 2A) and after arcing (FIG. 2B)
Figure 2B:
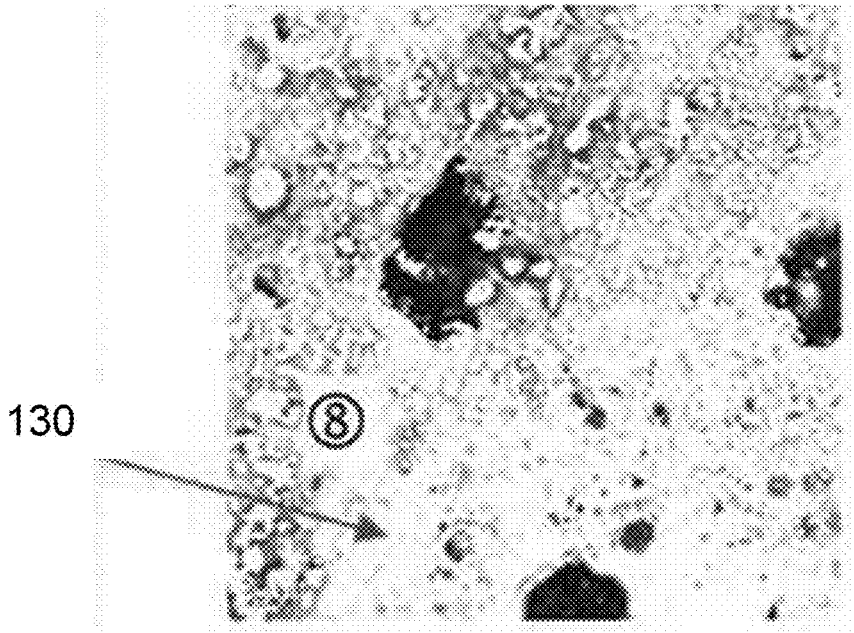

Referring to FIGS. 2A and 2B, back scattered scanning electron images of a non-limiting embodiment of a sintered electrical contact material according to the present disclosure including a salt dispersed within the silver matrix show the material before arcing (FIG. 2A) and after arcing (FIG. 2B). In FIG. 2B, a small droplet or condensate of silver (130)

is visible, indicating a reduced degree of silver loss after arcing. Because silver loss is reduced, the contact resistance can remain generally stable over a series of arc cycles. In certain non-limiting embodiments, an electrical contact material including a silver matrix with 3% (wt/wt) lithium fluoride can exhibit a net mass loss of 20 μg/arc. Net mass loss is the change in mass of both electrical contactors after arcing. The net mass loss of the electrical contact material according to the present disclosure compares favorably to electrical contact materials known in the art.

Figure 3:
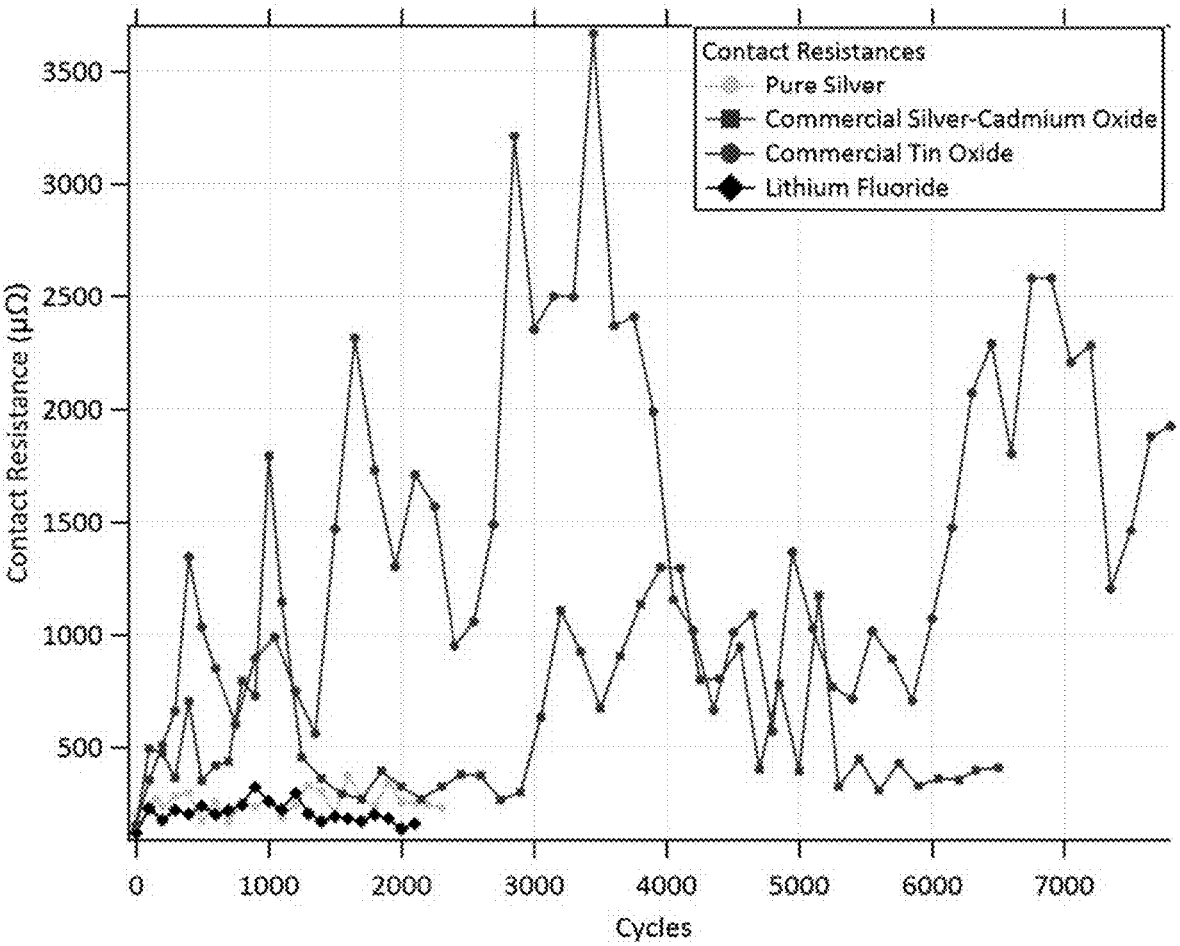
FIG. 3 is a graph plotting contact resistance as a function of the number of arc cycles for certain non-limiting embodiments of sintered electrical contact materials according to the present disclosure, and for Ag—CdO and Ag—$SnO_2$ composite materials.

Referring to FIG. 3, the contact resistance over a series of arc cycles is shown. "Contact resistance" is a term of art and will be readily understood by those having ordinary skill in materials for electronics. For example, contact resistance can refer to a ratio of the voltage to the current measured across electrical contactors. The contact resistance in FIG. 3 is measured by passing a current of 100 amperes through electrical contactors and measuring the resulting the potential difference across the electrical contactors. This resistance is described as "constriction" resistance. The accepted models for this phenomenon represent the interface between the contact surfaces as a constriction of the path available to the electrons in the bulk metal composite.

For pure silver electrical contactors, the initial potential difference can be about 10 mV, resulting in an initial contact resistance of about 100 μΩ. For commercially available electrical contactors containing a silver matrix in which cadmium oxide is incorporated, or electrical contactors containing a silver matrix in which 10% (wt/wt) tin oxide and 2% (wt/wt) bismuth oxide is incorporated, the initial potential difference can be greater than 40 mV, resulting in an initial contact resistance of greater than 400 μΩ. For silver composite electrical contactors according to certain non-limiting embodiments of the present disclosure including lithium fluoride dispersed therein as a salt, the initial potential difference can be about 20 mV, resulting in an initial contact resistance of about 200 μΩ. Silver composite electrical contactors according to certain non-limiting embodiments of the present disclosure can demonstrate an initial contact resistance of no greater than 400 μΩ.

Still referring to FIG. 3, a non-limiting embodiment of an electrical contact material according to the present disclosure was tested over the span of about 2000 arc cycles. This embodiment of the electrical contact material was formed of a silver matrix in which 3% by weight of lithium fluoride is incorporated as the salt. This embodiment of the electrical contact material exhibited a contact resistance of less than 500 μΩ after 2,000 arc cycles. In certain non-limiting embodiments, the electrical contact material according to the present disclosure may have a contact resistance of less than 400 μΩ after 2,000 arc cycles. In certain non-limiting embodiments, the electrical contact material according to the present disclosure may have a contact resistance of less than 300 μΩ after 2,000 arc cycles. In certain non-limiting embodiments, the electrical contact material according to the present disclosure may have a contact resistance of less than 200 μΩ after 2,000 arc cycles.

In contrast to electrical contactors according to certain non-limiting embodiments of the present disclosure, electrical contactors comprising tin oxide in a silver matrix exhibit a significant increase in contact resistance through repeated use, particularly after approximately 3,000 arc cycles and again after approximately 6,000 arc cycles. While not wishing to be bound by theory, it is believed that the increase in contact resistance of this material is due to slag formation on the material's surface. The formation of slag, an extended covalent network, is an exothermic process. Therefore, the formation of slag on the surface of the contactors can exacerbate the evaporation of silver from the contactors, leading to a reduced contactor lifetime. In contrast, with reference to FIG. 3, electrical contact material formed of a silver matrix in which lithium fluoride is incorporated exhibited generally stable contact resistance up to approximately 2,000 arc cycles. While not wishing to be bound by any particular theory, it is believed that the salt's endothermic phase change absorbed heat quickly at critical temperatures, thereby reducing silver vaporization at extreme temperatures.

Figure 4:
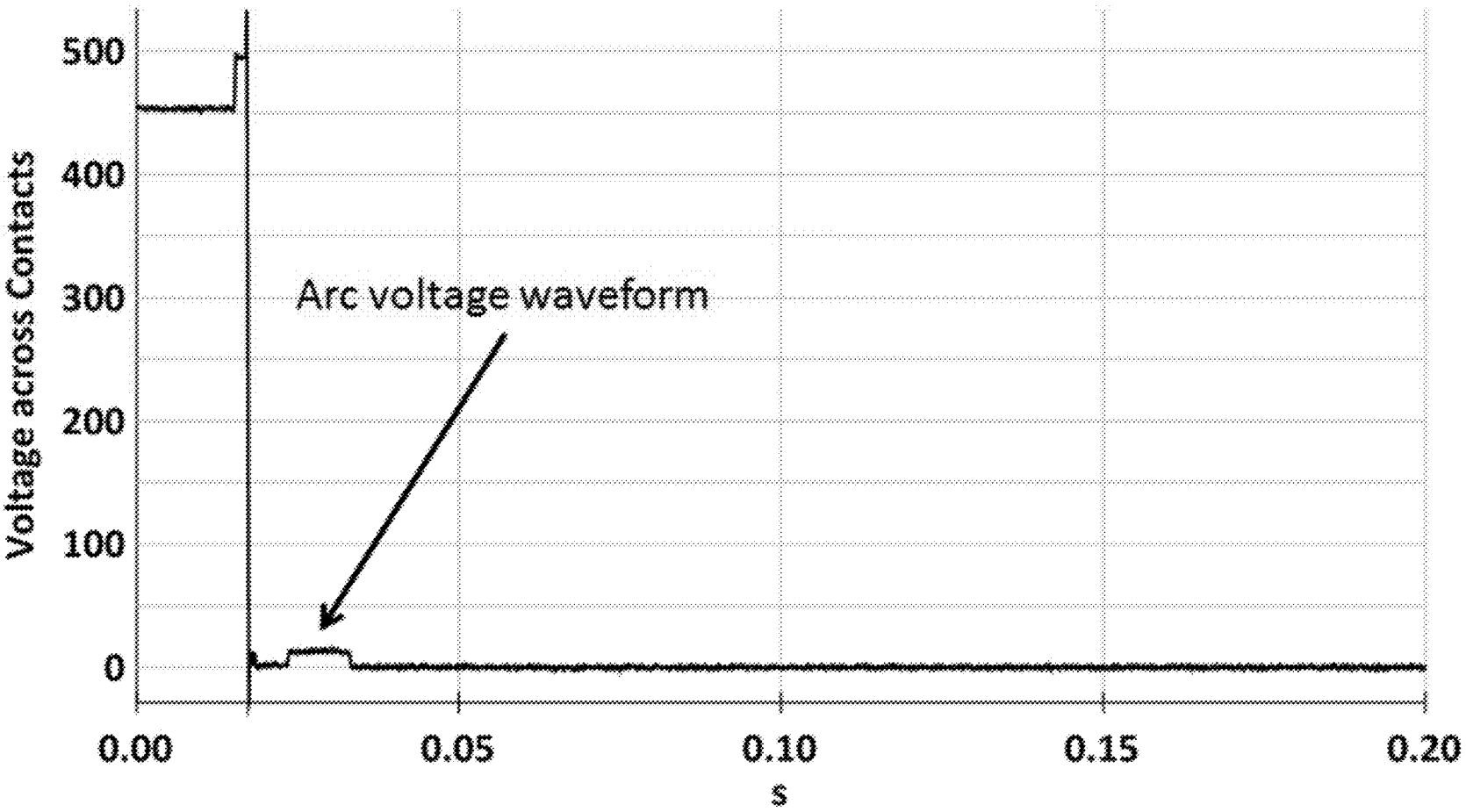
FIG. 4 is a graph plotting the voltage across contacts as a function of time for a non-limiting embodiment of a sintered electrical contact material according to the present disclosure.

Referring to FIG. 4, an arc voltage waveform for a non-limiting embodiment of contactors made from a sintered electrical contact material according to the present disclosure is illustrated as two of the electrical contactors were brought together. As illustrated in FIG. 4, a high voltage of approximately 450 V was present before the contactors were brought together. As the two electrical contactors were brought together, the voltage spiked to approximately 500 V, and an electric arc occurred between the contactors.

Figure 5:
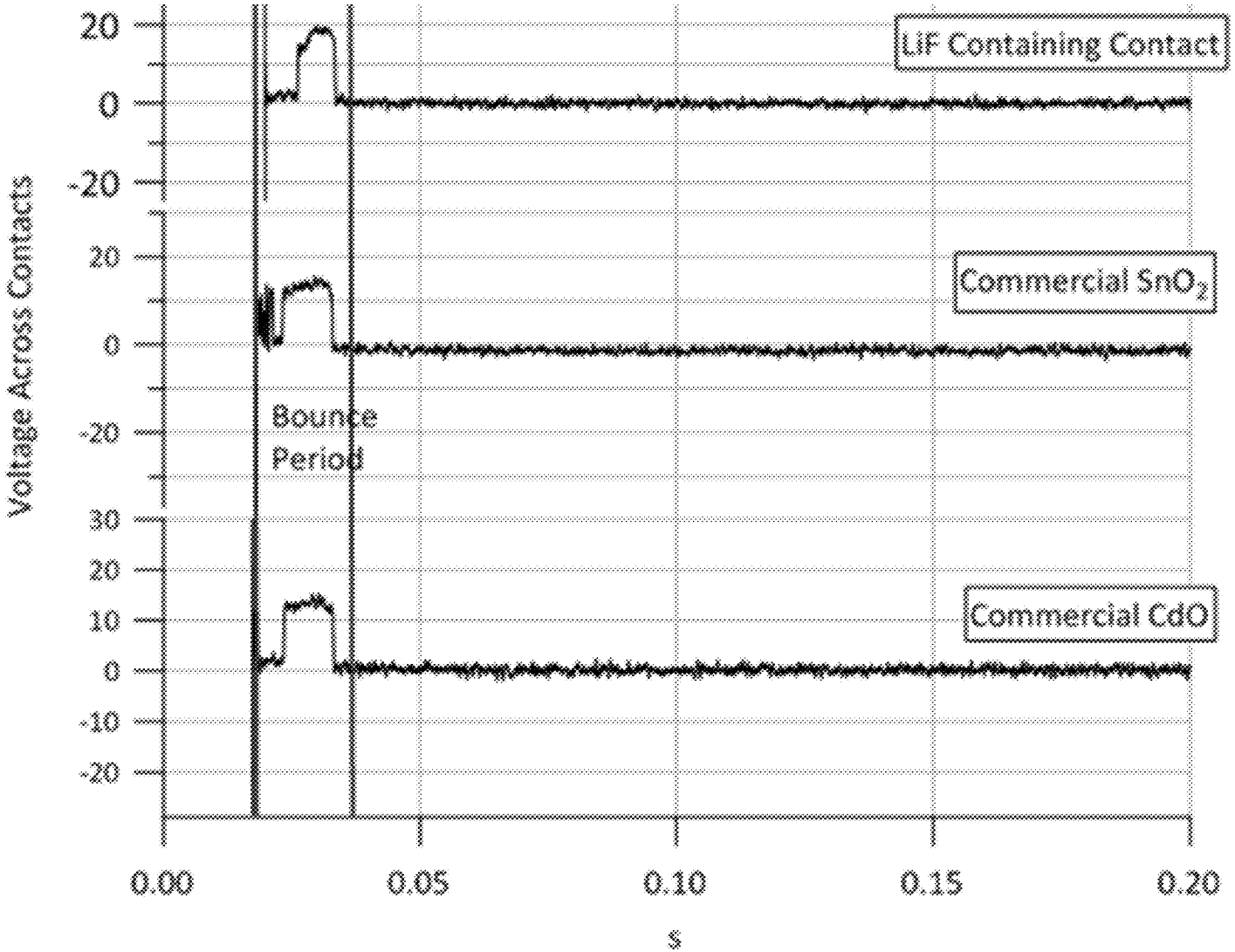
FIG. 5 is an enlarged graph plotting the voltage across two electrical contacts as a function of time for a non-limiting embodiment of a sintered electrical contact material according to the present disclosure, and for Ag—CdO and Ag—$SnO_2$ composite materials.

FIG. 5 is an enlarged graph plotting the voltage across two electrical contactors as a function of time for a sintered silver composite electrical contact material including 2% (wt/wt) of LiF, in comparison to a silver composite electrical contact material including CdO or $SnO_2$. In the period after the electric arc occurred between the contactors, the integral of the voltage over time represents the arc energy borne by the electrical contact material. A reduced arc energy correlates to a reduced amount of silver vaporized by the heat of the arc plasma, which in turn can lead to a more stable contact resistance over a series of arc cycles.

According to certain non-limiting embodiments, an electrical contact material according to the present disclosure may be produced by homogenizing a mixture comprising a metallic powder and salt particles. The salt particles constitute up to 15% (wt/wt) of the mixture. In certain non-limiting embodiments, the salt particles constitute 0.5 to 10% (wt/wt) of the mixture. In certain other non-limiting embodiments, the salt particles constitute 2 to 5% (wt/wt) of the mixture. According to certain non-limiting embodiments, the metallic powder may be selected from a metallic silver powder and a silver-containing metallic powder. According to certain non-limiting embodiments, the salt may be selected from lithium fluoride, zinc nitride, sodium sulfate, and magnesium carbonate. In certain non-limiting embodiments the metallic powder may be combined with the salt particles in a ball mill to provide the mixture. In certain non-limiting embodiments, the particle size of the salt is substantially similar to the particle size of the metallic powder to provide for sufficient mixing between the particles before compacting. For example, the salt and the particles of the metallic powder may both have a particle size ranging from 0.5 microns to 10 microns, or ranging from 1 micron to 10 microns. Additional mixing methods, such as shake-mixers, high energy mill, liquid mixers and drum mixers may be used in other non-limiting examples.

At least a portion of the homogenized mixture may be compacted to provide a compact. The compact may be sintered. The sintering may be accomplished through, for example, electric current assisted sintering, pressureless sintering, and/or liquid phase sintering of the compact. According to certain non-limiting embodiments, sintering may occur in a temperature range below 900° C. For example, sintering may occur in a temperature range between ambient temperature and 900° C. According to other non-limiting embodiments, sintering may occur in a temperature range between 500° C. and 900° C. According to certain non-limiting embodiments, sintering may occur at temperatures up to 840° C. According to certain other non-limiting embodiments, sintering may occur at temperatures up to 750° C. According to certain other non-limiting embodiments, sintering may occur at temperatures up to 500° C.

According to certain non-limiting embodiments, the compact is maintained at the sintering temperature for up to two hours to sinter the compact. As used herein, phrases such as "maintained at" with reference to a temperature, temperature range, or minimum temperature, mean that at least a desired portion of the compact reaches, and is held at, a temperature at least equal to the referenced temperature or within the referenced temperature range. According to certain non-limiting embodiments, the compact is sintered by maintaining the compact at a first temperature for a first period of time and subsequently at a second, higher temperature for a second period of time. According to certain non-limiting embodiments, the first and second temperatures may differ by at least 150° C. According to certain other embodiments, the first and second temperatures may differ by less than 150° C. According to certain non-limiting embodiments, the first and second periods of time may be the same. According to certain other non-limiting embodiments, the first and second periods of time may be different.

According to certain non-limiting embodiments, the compact may be sintered under a pressure of less than 1 atm (i.e, less than 101,325 Pa). For example, sintering may be conducted under a pressure in the range of 0.1 Pa to less than 101,325 Pa. According to certain non-limiting embodiments, sintering is conducted under a pressure that is in the range of 133 Pa to less than 101,325 Pa.

According to certain non-limiting embodiments, after sintering, the sintered compact may be further mechanically processed. The additional mechanical processing may include, for example, forging or rolling, e.g., to a thickness less than 1 mm. According to certain non-limiting embodiments, the sintered compact may be forged and rolled to a thickness less than 0.5 mm. According to certain non-limiting embodiments, the sintered electrical contact material is processed so that it is in the form of at least a region of an electrical switch or an electrical contactor.

Although the foregoing description has necessarily presented only a limited number of embodiments, those of ordinary skill in the relevant art will appreciate that various changes in the electrical contact materials and methods and other details of the examples that have been described and illustrated herein may be made by those skilled in the art, and all such modifications will remain within the principle and scope of the present disclosure as expressed herein and in the appended claims. It is understood, therefore, that the present invention is not limited to the particular embodiments disclosed or incorporated herein, but is intended to cover modifications that are within the principle and scope of the invention, as defined by the claims. It will also be appreciated by those skilled in the art that changes could be made to the embodiments above without departing from the broad inventive concept thereof.

The electrical contact materials and methods described in this specification can comprise, consist of, or consist essentially of the various features and characteristics described in this specification. The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "at least one salt" means one or more salts, and thus, possibly, more than one salt is contemplated and can be employed or used in an implementation of the described electrical contact materials and methods. Further, the use of a singular noun includes the plural, and the use of a plural noun includes the singular, unless the context of the usage requires otherwise.

We claim:

1. A sintered electrical contact material comprising:

a silver matrix;

at least 0.5% to 15% (wt/wt) of at least one salt dispersed within the silver matrix, wherein the at least one salt has a melting temperature below 960° C.; and no more than 100 ppm (wt/wt) of cadmium and cadmium compounds, wherein the at least one salt comprises one or more of zinc nitride, sodium sulfate, and magnesium carbonate, and wherein the at least one salt dispersed in the silver matrix has an average particle size distribution in the range of 0.5 microns to 10 microns.

2. The sintered electrical contact material of claim 1, comprising 0.5 to 10% (wt/wt) of the at least one salt.

3. The sintered electrical contact material of claim 1, comprising 2 to 5% (wt/wt) of the at least one salt.

4. The sintered electrical contact material of claim 1, wherein the sintered electrical contact material has an initial contact resistance no greater than 400 μΩ.

5. The sintered electrical contact material of claim 1, wherein the sintered electrical contact material is free of cadmium and cadmium compounds.

6. The sintered electrical contact material of claim 1, wherein the sintered electrical contact material has a contact resistance no greater than 500 μΩ after 2,000 arc cycles.

7. The sintered electrical contact material of claim 1, wherein the sintered electrical contact material has a contact resistance in the range of 100 μΩ to 500 μΩ after 2,000 arc cycles.

8. An article of manufacture including the sintered electrical contact material recited in claim 1.

9. The article of manufacture of claim 8, wherein the article of manufacture is selected from an electrical contactor and an electrical switch.

10. A method of producing a sintered electrical contact material, the method comprising:

homogenizing a mixture comprising a silver powder and at least 0.5% to 15% (wt/wt) of particles of at least one salt, wherein the at least one salt has a melting temperature below 960° C. and an average particle size distribution in the range of 0.5 microns to 10 microns, and the at least one salt comprises one or more of zinc nitride, sodium sulfate, and magnesium carbonate;

compacting at least a portion of the homogenized mixture to provide a compact; and sintering the compact.

11. The method of claim 10, wherein the compact is sintered in a temperature range of 500 to 900° C. at a pressure from 0.1 Pa to less than 101,325 Pa, or from 101,325 Pa to 20 M Pa.

* * * * *